US006572921B1

(12) United States Patent
Rousselet

(10) Patent No.: US 6,572,921 B1
(45) Date of Patent: Jun. 3, 2003

(54) METHOD OF APPLYING DECORATION ON AN ARTICLE

(75) Inventor: Guilhem Rousselet, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/706,776

(22) Filed: Nov. 7, 2000

(30) Foreign Application Priority Data

Nov. 9, 1999 (FR) ..... 99 14057

(51) Int. Cl.[7] ..... B05D 7/22; B05D 3/00

(52) U.S. Cl. ..... 427/230; 427/256; 427/374.1; 427/374.4; 427/393.5; 427/398.2

(58) Field of Search ..... 427/230, 256, 427/393.5, 398.2, 374.1, 374.4

(56) References Cited

U.S. PATENT DOCUMENTS

| | | | | | |
|---|---|---|---|---|---|
| 3,860,388 | A | * | 1/1975 | Haigh | 101/464 |
| 4,238,190 | A | * | 12/1980 | Rejto | 156/219 |
| 4,352,721 | A | * | 10/1982 | Park et al. | 101/470 |
| 4,640,191 | A | * | 2/1987 | Bradley | 101/470 |
| 4,715,913 | A | | 12/1987 | Middleton | |
| 4,795,477 | A | * | 1/1989 | Kusumgar et al. | 427/256 |
| 4,874,454 | A | * | 10/1989 | Talalay et al. | 156/240 |
| 5,019,193 | A | * | 5/1991 | Aramini | 156/215 |
| 5,160,505 | A | * | 11/1992 | Seveno et al. | 101/115 |
| 5,718,792 | A | * | 2/1998 | Goode | 156/228 |
| 5,729,272 | A | * | 3/1998 | Kikuchi | 156/230 |
| 5,997,678 | A | * | 12/1999 | Wess et al. | 156/240 |

FOREIGN PATENT DOCUMENTS

| | | | |
|---|---|---|---|
| DE | 39 35 602 | A | 5/1991 |
| DE | 197 09 498 | A | 9/1997 |
| EP | 0 451 067 | A | 10/1991 |
| EP | 0 573 675 | A | 12/1993 |
| EP | 0 606 189 | A | 7/1994 |
| FR | 2 702 416 | A | 9/1994 |
| JP | 60-201952 | | 10/1985 |
| JP | 04138281 | A | 5/1992 |
| JP | 10-181181 | | 7/1998 |
| JP | 11-034592 | | 2/1999 |
| NL | 7 308 220 | A | 12/1974 |

* cited by examiner

*Primary Examiner*—Shrive P. Beck
*Assistant Examiner*—Kirsten Crockford Jolley
(74) *Attorney, Agent, or Firm*—Oliff & Berridge, PLC

(57) ABSTRACT

A method of applying decoration onto an article, the method comprising the steps consisting in:

placing backing coated in a sublimable ink in contact with a face of the article; and heating the backing with the help of heating means to cause the ink to sublime and be transferred onto the article, while cooling the opposite face of the article with the help of cooling means.

24 Claims, 2 Drawing Sheets

METHOD OF APPLYING DECORATION ON AN ARTICLE

The present invention relates to applying decoration on an article, using a method of deposition by sublimation in which a sublimable ink carried by a flexible backing is transferred onto a face of the article by means of heat and pressure.

BACKGROUND OF THE INVENTION

European patents EP-B1-0 451 067 and EP-B1-0 606 189 describe methods of this type.

The temperature at which the flexible backing needs to be raised in order to cause the ink to sublime lies typically in the range 140° C. to 250° C.

Thus, this method is used at present only for decorating articles made out of materials that can withstand such temperatures in satisfactory manner.

Nevertheless, in the field of packaging, it is common practice to make articles such as closure devices or receptacles out of polyethylene terephthalate or polypropylene.

Such articles cannot be decorated by known sublimation deposition methods since the heating of the flexible backing required for subliming the ink would give rise to deformation preventing such articles from being functional.

OBJECTS AND SUMMARY OF THE INVENTION

The present invention provides a novel method of deposition by sublimation enabling decoration to be applied onto an article, the method comprising the steps consisting in:

- placing backing coated in a sublimable ink in contact with a face of the article; and
- heating the backing with the help of heating means to cause the ink to sublime and be transferred onto the article, while cooling the opposite face of the article with the help of cooling means.

The invention makes it possible to decorate articles themselves made out of plastics materials whose ability to withstand high temperatures is normally insufficient to be capable of being decorated by known methods of deposition by sublimation.

Articles made of polyethylene terephthalate or of polypropylene can be decorated in this way.

It is also possible to decorate articles made of styrene-based thermoplastics (in particular polystyrenes including high impact polystyrene and super high impact polystyrene, and copolymers thereof, in particular SAN, ABS, MABS, NAS, ABS/PC, or polyacrylics).

By means of the new method of the invention, it is also possible to decorate a hollow article by applying the backing on an inside face of the article even if the article is of small dimensions since the corresponding outside face of the article is then cooled.

When the article is made of a transparent plastics material, it is possible to obtain particularly advantageous appearance effects when the decoration is deposited on the inside face thereof.

The above-mentioned heating means can comprise a flexible bag into which a hot, liquid or gaseous fluid is injected or blown, and preferably compressed hot air.

The flexible bag is easily inserted inside the article in the deflated state, and once inflated it serves to press the backing against the inside face of the article and to supply the heat necessary for causing the ink to sublime and be transferred.

The outside surface of such a heating member advantageously presents a certain amount of deformability, so as to fit closely to the shape of the inside face of the article.

The cooling means can be constituted by a cooling core on which the article is engaged when the decoration is applied to the outside face of the article.

When the decoration is applied to the inside face of the article, the cooling means can comprise means for blowing or spraying a stream of liquid or gaseous cooling fluid onto the outside face of the article, and preferably a stream of cold air.

The invention also provides an article decorated by means of a method as defined above.

The invention also provides a hollow article having decoration on its inside face that is obtained by subliming ink by means of a method comprising the steps consisting in:

- placing backing coated in a sublimable ink in contact with an inside face of the article; and
- heating the backing with the help of heating means to cause the ink to sublime and be transferred onto the article, while cooling the opposite face of the article as much as necessary with the help of cooling means.

BRIEF DESCRIPTION OF THE DRAWINGS

The invention will be better understood on reading the following detailed description of non-limiting implementations, and on examining the accompanying drawings, in which.

MORE DETAILED DESCRIPTION

Figure 1:
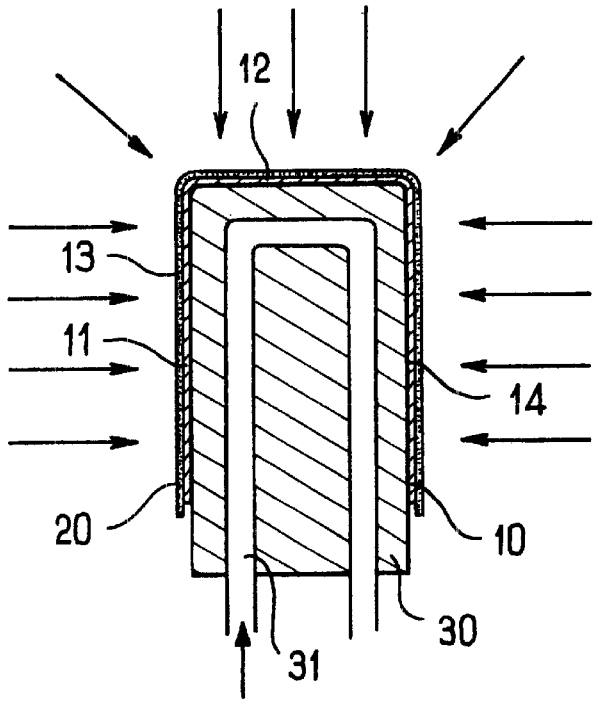
FIG. 1 is a diagrammatic section view showing an implementation of the method for decorating the outside face of an article.

FIG. 1 shows an article 10 of plastics material, constituted by a piece that is to be assembled with some other element, for example a stopper or a lid.

The article 10 has a tubular wall 11 closed at its top end by a top wall 12.

Flexible backing 20, e.g. constituted by cloth, paper, or a film, is coated in a sublimable ink which is deposited by printing, and it is put into contact with the outside surface 13 of the article 10.

The article 10 is engaged on a cooling core 30 for cooling its inside surface 14.

In the example described, the cooling core 30 is made of metal and has internal ducts 31 conveying a cooling fluid at a temperature of 10° C., for example.

To transfer the decoration onto the article, hot air is blown against the outside surface of the flexible backing 20 so as to raise it to a temperature lying in the range 150° C. to 250° C., and preferably in the range 180° C. to 220° C.

The presence of the cooling core 30 enables the article 10 to conserve its dimensions in spite of the backing 20 being heated.

After a certain length of time has elapsed, the ink carried by the backing 20 sublimes and migrates onto the article 10.

The depth to which the ink penetrates into the article depends in particular on the duration of heating and on the heating temperature, and it can be about 300 $\mu$m, for example.

Once the ink has been transferred, the backing 20 is withdrawn.

The article 10 can be coated in a layer of protective varnish compatible with the sublimable ink used, e.g. a polyurethane or polyester varnish.

Figure 2:
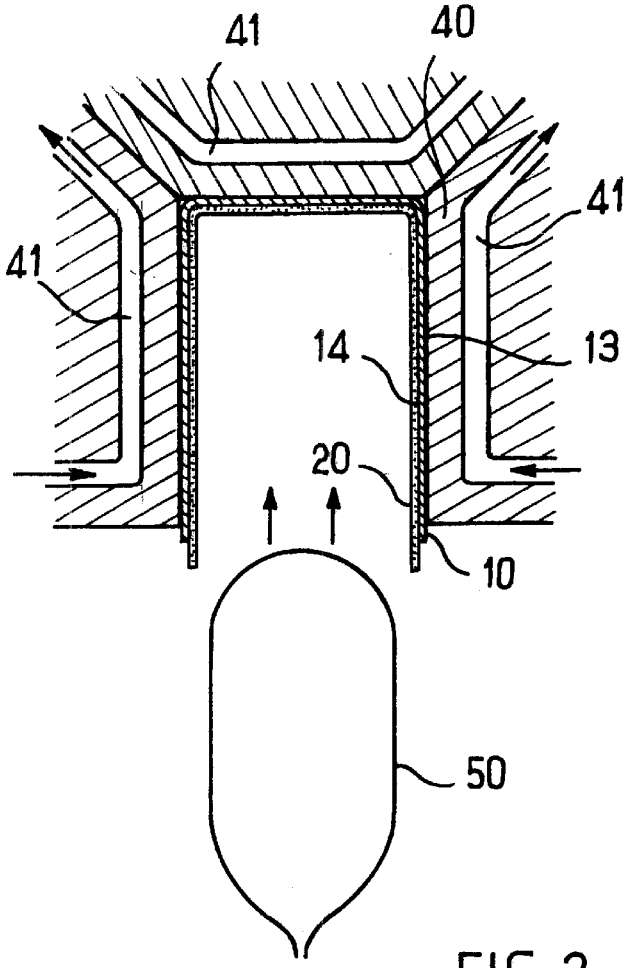
FIG. 2 shows an implementation of the method for decorating the inside face of a hollow article.

There follows a description with reference to FIG. 2 of how the method can be implemented to decorate the inside surface of a hollow article, constituted in this case by the above-described article 10.

On this occasion, the flexible backing 20 is placed in contact with the inside surface 14 of the article 10.

A cooling bell 40 having internal ducts 41 carrying a cooling fluid, e.g. a liquid at a temperature of 10° C., is placed around the article 10 in contact with its outside surface 13.

A flexible bag 50 is inserted into the article 10 while in the deflated state and a hot fluid, in this case constituted by compressed hot air, is blown into the bag to cause it to expand and to press its wall against the backing 20.

The flexible bag 50 raises the backing 20 to a temperature that is high enough to cause the ink to sublime and be transferred onto the inside surface 14 of the article 10.

Once the ink has been transferred, the flexible bag 50 can be deflated and extracted from the article 10.

The article 10 is advantageously made of a transparent plastics material, thereby enabling advantageous appearance effects to be obtained.

Figure 3:
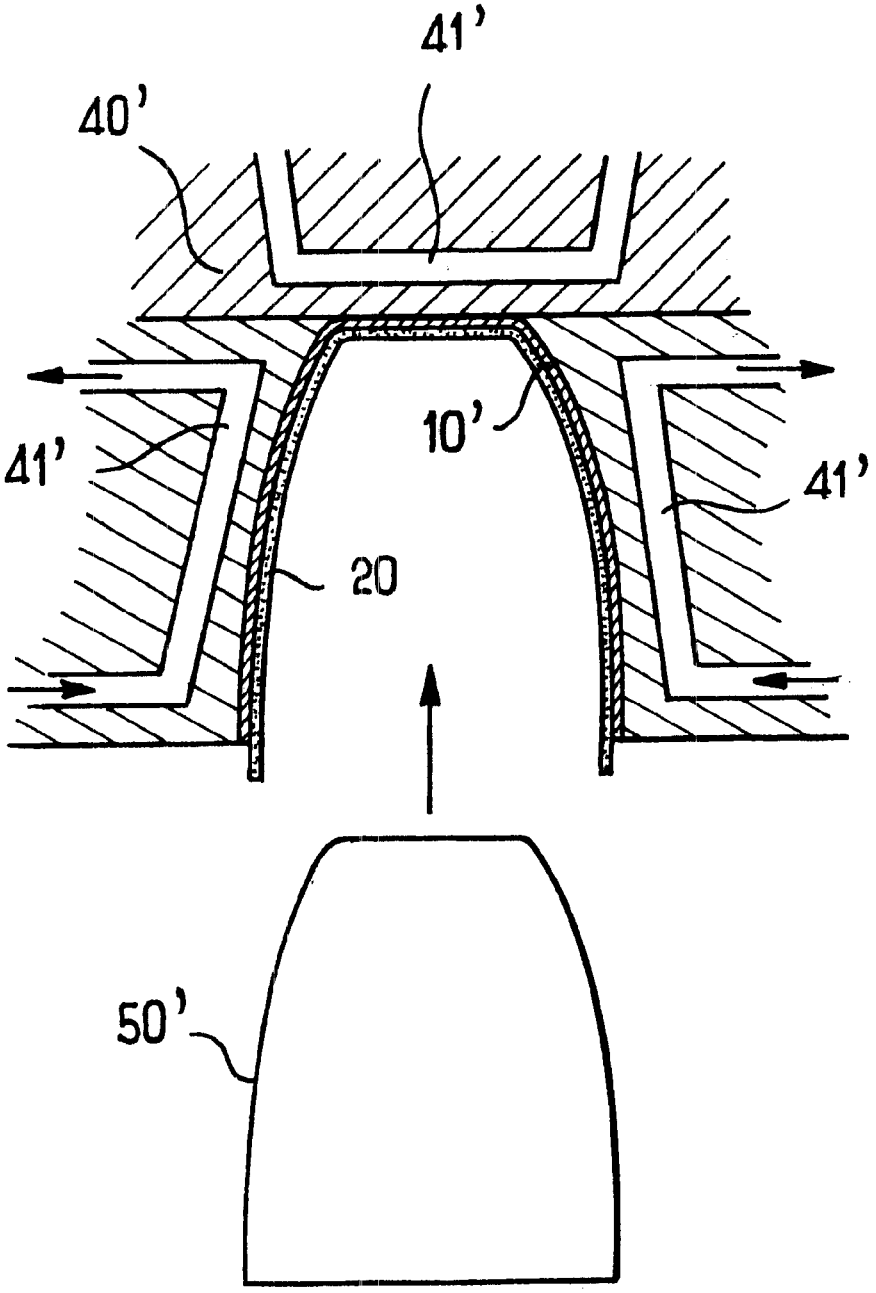
FIG. 3 shows a variant implementation of the method for decorating the inside face of a hollow article.

FIG. 3 shows a hollow article 10' that is generally flared in shape.

Under such circumstances, it is possible to use a heating member 50' as the heating means, which member has an outside surface that is complementary in shape to the inside surface of the article 10'.

The cooling bell 40 used has a shape that matches that of the outside surface of the article 10'.

The wall of the heating member 50' that is to come into contact with the flexible backing 20 is advantageously somewhat deformable so as to fit closely to the shape of the inside surface of the article 10'.

This wall can be made of a silicone elastomer, for example.

By means of the invention it is possible to decorate articles, and in particular articles which are not textiles, that are made out of thermoplastic materials such as polyethylene terephthalate (PET), polypropylene (PP), polystyrene (PS), styrene acrylonitrile (SAN), acrylonitrile butadiene styrene (ABS), methacrylic ABS (MABS), a mixture of ABS and polycarbonate (NAS), ABS/polycarbonate (ABS/PC), or polymethyl methacrylate (PMMA), without fearing significant changes in dimension that would prevent such articles from being functional.

Naturally, the invention is not limited to the implementations described.

Thus, it is possible to decorate an article by applying decoration to its inside or outside face using the sublimation method of the invention while applying other decoration onto its opposite face by any method, other than a method of deposition by sublimation.

What is claimed is:

1. A method of applying decoration onto a non-textile article, comprising:

placing a backing coated in a sublimable ink in contact with a first face of the article; and heating the backing to cause the ink to sublime and be transferred onto the article while cooling a second face of the article opposite to the first face, wherein said heating is carried out with a flexible bag into which a hot fluid is blown or injected.

2. A method according to claim 1, wherein the backing is pressed against an inside face of the article.

3. A method according to claim 1, wherein the article is made out of at least one material selected from the following list: polyethylene terephthalate; polypropylene; styrene thermoplastics; polystyrenes; high impact polystyrenes; super high impact polystyrenes and copolymers thereof.

4. A method according to claim 1, wherein said backing is raised to a temperature lying in the range 150° C. to 250° C.

5. A method according to claim 1, wherein the article is constituted by a part for assembling with another element.

6. A method according to claim 1, wherein the article is one of a stopper and a lid.

7. A method according to claim 1, wherein the article is made of a transparent plastics material.

8. A method according to claim 1, wherein the cooling is carried out with a cooling core on which the article is engaged.

9. A method according to claim 1, wherein the article is made of plastic.

10. A method according to claim 1, wherein the article is made out of at least one material selected from the following list: styrene-acrylonitrile (SAN), acrylonitrile-butadiene-styrene (ABS), methyl-methacrylate/ABS (MABS), styrene-methyl-methacrylate (NAS), ABS/polycarbonate (PC) and polyacrylics.

11. A method according to claim 4, wherein said backing is raised to a temperature lying in the range 180° C. to 220° C.

12. A method according to claim 1, wherein the article is hollow.

13. A method of applying decoration onto a hollow article, the method comprising:

placing a backing coated in a sublimable ink in contact with a first face of the article; and heating the backing to cause the ink to sublime and be transferred onto the article while cooling a second face of the article opposite to the first face.

14. A method according to claim 13, wherein the backing is pressed against an inside face of the article.

15. A method according to claim 13, wherein the article is made out of at least one material selected from the following list: polyethylene terephthalate; polypropylene; styrene thertnoplastics; polystyrenes; high impact polystyrenes; super high impact polystyrenes and copolymers thereof.

16. A method according to claim 13, wherein said backing is raised to a temperature lying in the range 150° C. to 250° C.

17. A method according to claim 16, wherein said backing is raised to a temperature lying in the range 180° C. to 220° C.

18. A method according to claim 13, wherein the article is constituted by a part for assembling with another element.

19. A method according to claim 13, wherein the article is one of a stopper and a lid.

20. A method according to claim 13, wherein the article is made of a transparent plastics material.

21. A method according to claim 13, wherein said heating is carried out with a flexible bag into which a hot fluid is blown or injected.

22. A method according to claim 13, wherein the cooling is carried out with a cooling core on which the article is engaged.

23. A method according to claim 13, wherein the heating is carried out with a heating member having a surface whose shape is substantially complementary to the shape of the article that is to be decorated.

24. A method according to claim 13, wherein the article is made of plastic.

* * * * *